United States Patent [19]

Lagervall

[11] 3,982,293

[45] Sept. 28, 1976

[54] FOOT RESTS FOR KAYAKS

[76] Inventor: Otto Leonard Lagervall, 724 N. 34th Ave., Yakima, Wash. 98902

[22] Filed: Mar. 31, 1975

[21] Appl. No.: 563,346

[52] U.S. Cl. ..... 9/7
[51] Int. Cl.[2] ..... B63B 29/00
[58] Field of Search ..... 9/7, 1 R, 1 D, 1 K

[56] References Cited

UNITED STATES PATENTS

| | | | |
|---|---|---|---|
| 457,236 | 8/1891 | Truscott | 9/7 |
| 1,621,423 | 3/1927 | Long | 9/7 |
| 3,789,444 | 2/1974 | McCord | 9/7 |
| 3,884,522 | 5/1975 | Arima et al. | 9/7 |

FOREIGN PATENTS OR APPLICATIONS

| | | | |
|---|---|---|---|
| 644,045 | 10/1928 | France | 9/7 |
| 769,457 | 8/1934 | France | 9/7 |

*Primary Examiner*—Trygve M. Blix
*Assistant Examiner*—Stuart M. Goldstein

[57] ABSTRACT

This is an adjustable foot rest assembly for kayaks, including a pair of channel members, with indexing slots and an inverted T-slot along the base, serving as a track along which a pair of foot pad assemblies are slidably moved. The channel members, or guide rails, are secured to each side, inside the front section of the kayak where the feet of the paddler are. The foot pad assembly, including an integrally connected hollow I-beam, a foot pad or rest, and a spring-actuated trigger with indexing pin, is supported in the channel members on which it is adapted to slide from a rear position to an extended or forward position, thereby accommodating the leg length of taller or shorter kayakers. The trigger assembly, contained within the foot pad assembly, includes an integrally connected spring and indexing pin, permitting the foot pad assembly to be moved forward or backward in the channel, when the trigger is depressed and indexing pin raised; and likewise, held firmly in place when the trigger is released and indexing pin spring-pressed into the desired indexing slot of the channel.

Figure 1:
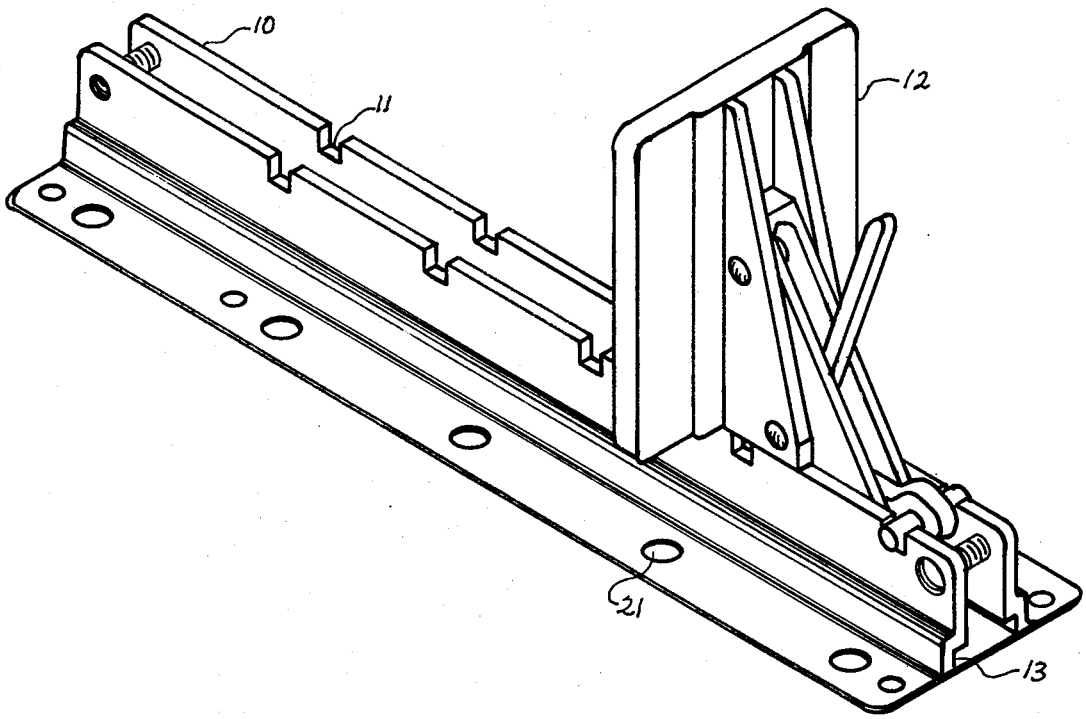
Figure 2:
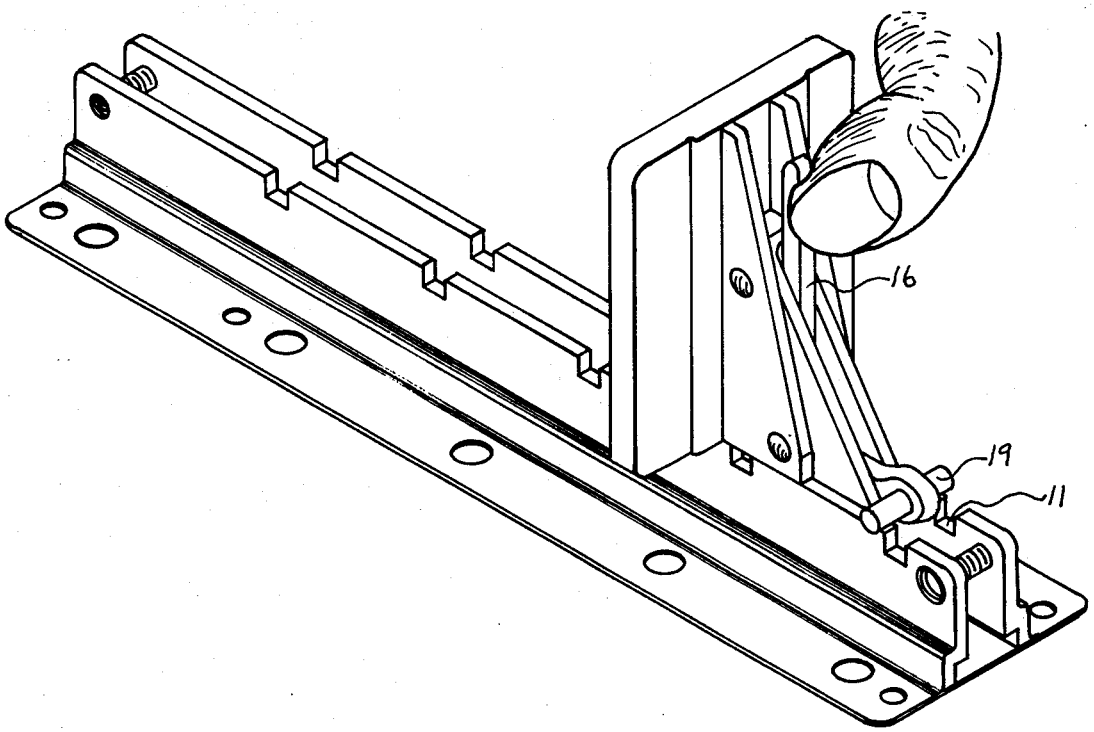
Figure 4:
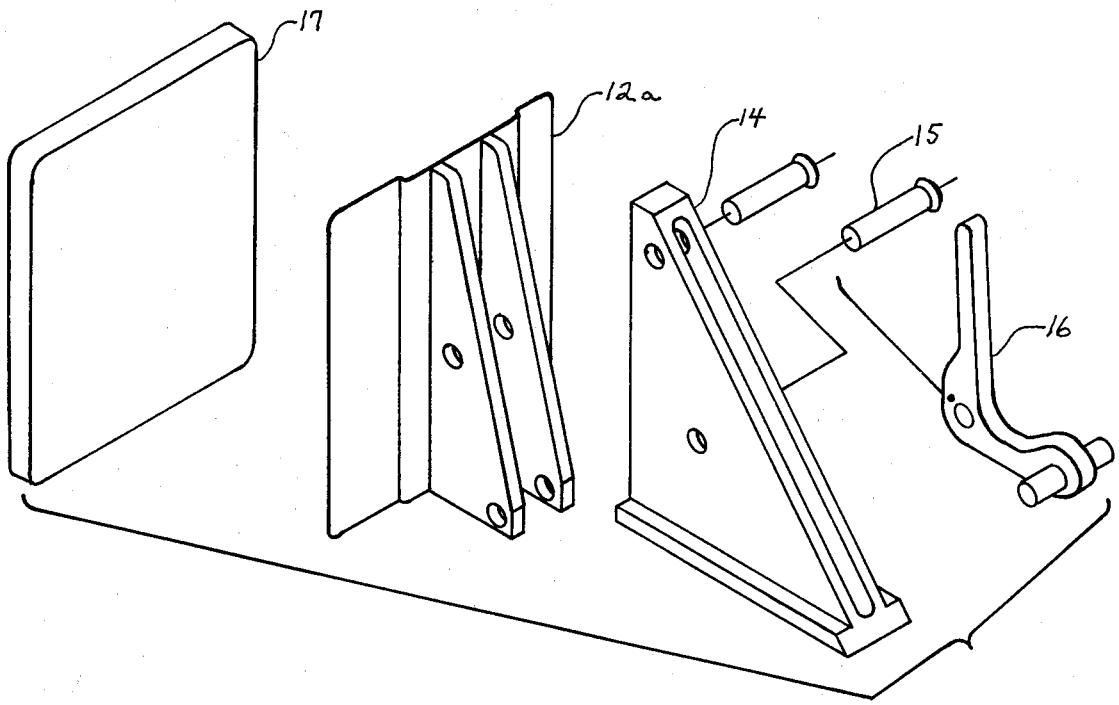
Figure 3:
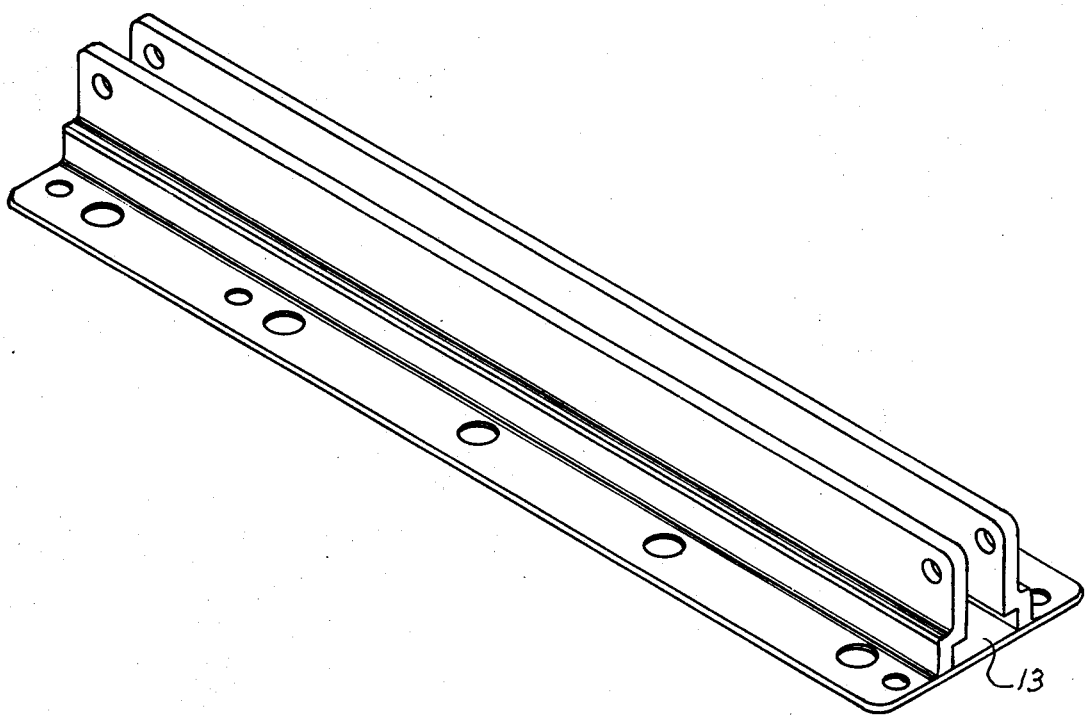
Figure 5:
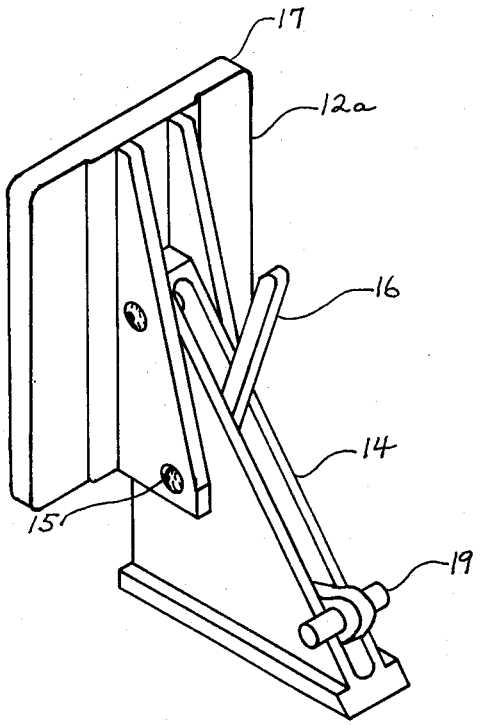
Figure 6:
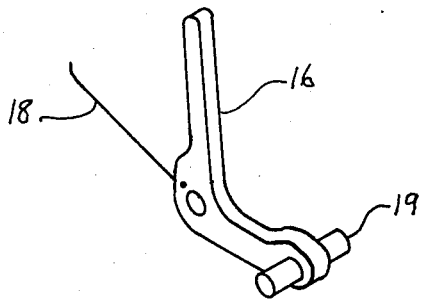
Figure 7:
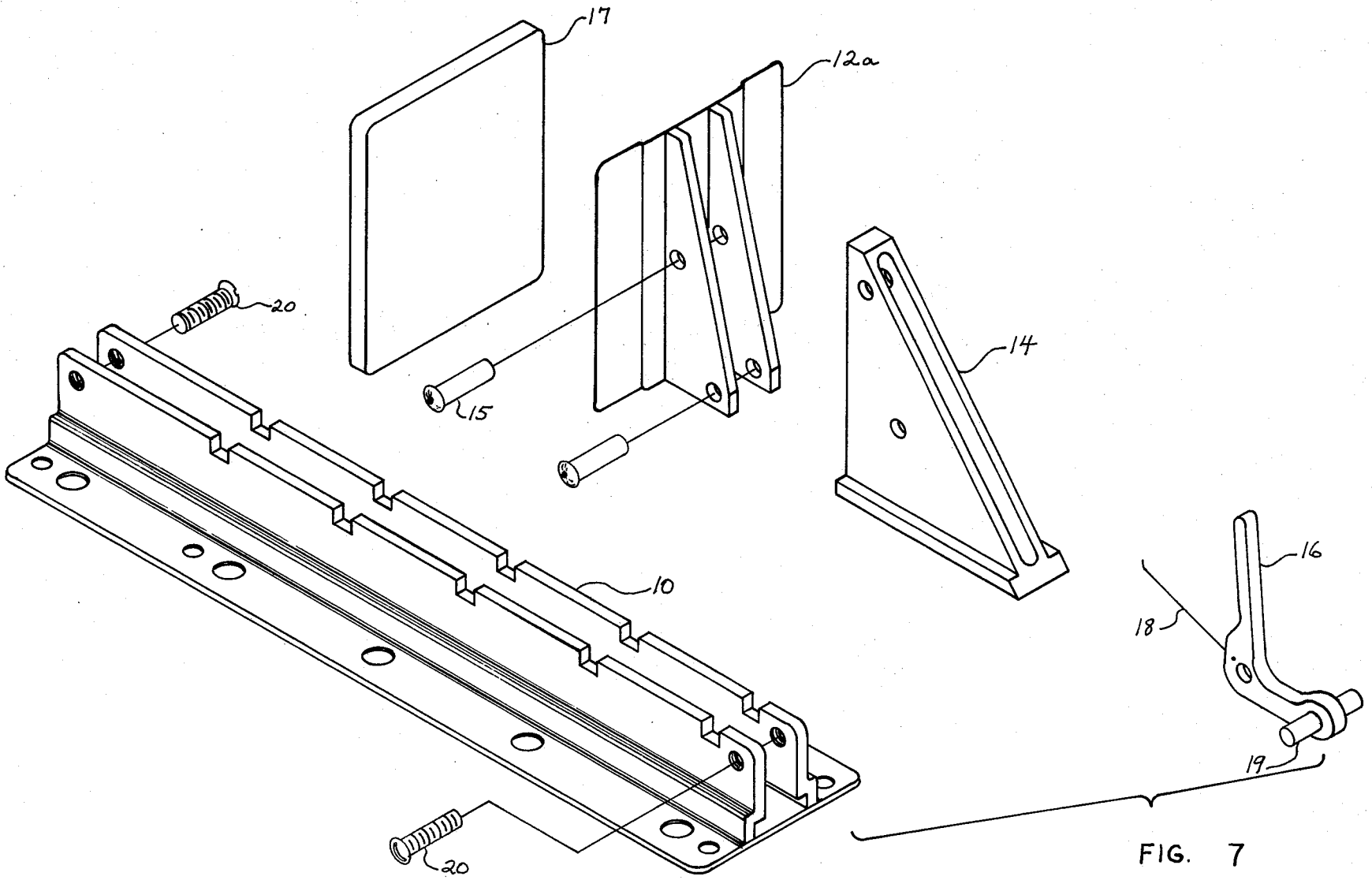

4 Claims, 7 Drawing Figures